United States Patent [19]

Furukubo et al.

[11] 4,075,530

[45] Feb. 21, 1978

[54] HIGH PRESSURE SODIUM VAPOR LAMP OF UNSATURATED VAPOR PRESSURE TYPE

[75] Inventors: Haruo Furukubo, Kyoto; Yasaburo Takezi, Shiga; Kenzi Takatuka, Kyoto, all of Japan

[73] Assignee: Japan Storage Battery Company Limited, Kyoto, Japan

[21] Appl. No.: 679,288

[22] Filed: Apr. 21, 1976

[51] Int. Cl.[2] ..... H01J 61/20; H01J 61/22; H01J 61/30

[52] U.S. Cl. ..... 313/229; 313/318

[58] Field of Search ..... 313/229, 318

[56] References Cited

U.S. PATENT DOCUMENTS

| | | | |
|---|---|---|---|
| 3,315,116 | 4/1967 | Beese | 313/318 X |
| 3,453,477 | 7/1969 | Hanneman et al. | 313/229 X |

*Primary Examiner*—Palmer C. Demeo

*Attorney, Agent, or Firm*—Sughrue, Rothwell, Mion, Zinn and Macpeak

[57] ABSTRACT

In a high pressure sodium vapor lamp, sufficiently small quantities of sodium and mercury are inserted therein so that all of the added sodium and mercury will be vaporized when the lamp is operated. The quantities are so selected that a completed lamp exhibits high efficiency, remarkable color rendition and durability. Also, the lamp can produce a suitable arc voltage by means of a less expensive ballast.

The small quantity of sodium added is accurately controlled by decomposing sodium azide NaN3. The small quantity of mercury is accurately controlled by decomposing Ti-Hg alloy or Al-Zr-Ti-Hg alloy. In order to assure the perfect vaporization of the sodium and mercury filling the lamp, the exterior portions of the ends of the arc tube have wound thereon heat insulatng sleeves composed of a refractory insulating packing material. Metal plates are tightly wound around the packing materials to hold the sleeves on the tube without any securing means.

5 Claims, 4 Drawing Figures

FIG 1
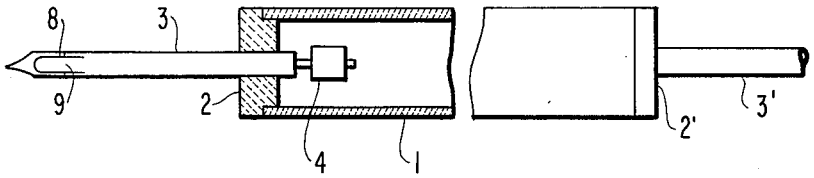
FIG 4
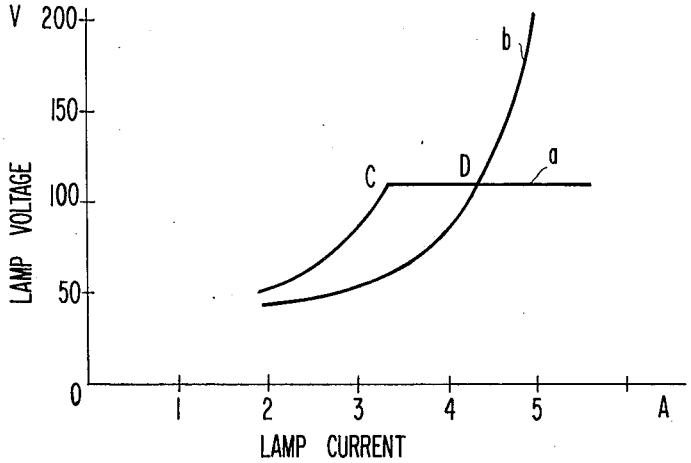
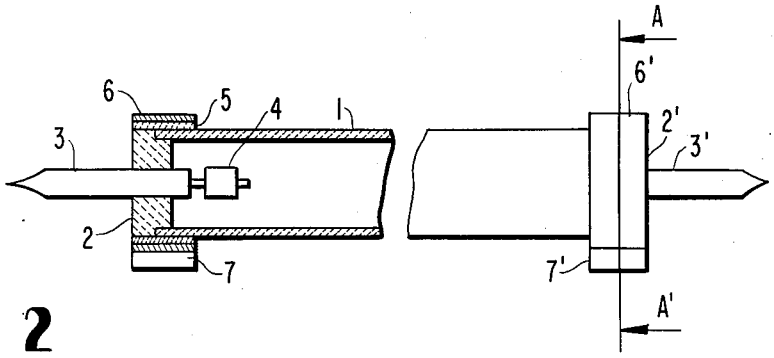
FIG 2
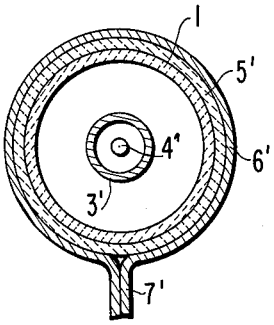
FIG 3

HIGH PRESSURE SODIUM VAPOR LAMP OF UNSATURATED VAPOR PRESSURE TYPE

BACKGROUND OF THE INVENTION

The present invention relates to sodium vapor lamps and in particular to an improved method for fabricating such lamps and improved lamps resulting therefrom.

High pressure sodium vapor lamps, which constitute one known type of saturated vapor pressure electric discharge lamps, are known in the art. Those which are commercially available are filled with large amounts of sodium and mercury, and parts thereof become accumulated in the liquid phase as an amalgam at the coolest points within the arc tube of the lamp. In such lamps, the operating characteristics, especially the arc voltage, tend to fluctuate depending on those factors which will affect the temperature of the coolest point in the arc tube. One factor, for example, would be a variation of the source voltage.

It is theoretically known that the above shortcoming can be overcome by limiting the amount of sodium and mercury to that which will become totally vaporized. In this connection it is possible to work out by calculation, the maximum allowable amount of the sodium and mercury, i.e. the maximum amount which would not result in the condensation of the substances under working condition.

Despite the latter, no one has previously been able to discover and disclose the appropriate amount of fillers (i.e. sodium and mercury) to be used for a practical electric discharge lamp having high efficiency, acceptable color rendition, long service life and suitable stabilized arc voltage using an economical ballast. This is attributable to the fact that the appropriate amount of fillers is extremely small and that sodium is one of the chemically active elements. It is quite difficult to pick up and accurately fill such a small amount of chemically active sodium without being contaminated by other atmospheric elements such as oxygen or moisture. At the same time, it is very difficult to form a very small drop of mercury on an industrial scale, since mercury has a large surface tension and a large specific gravity.

SUMMARY OF THE INVENTION

It is therefore an object of the present invention to overcome the above described shortcoming of the prior art by limiting the amounts of sodium and mercury added to a sodium vapor lamp to the ranges of between 0.007 mg and 0.054 mg of sodium and between 0.054 mg and 0.6 mg of mercury per cubic centimeter of the volume of the arc tube, thereby providing a practically usable high pressure sodium vapor lamp satisfying all requirements for high intensity electric discharge lamp.

BIREF EXPLANATION OF THE DRAWINGS

FIG. 1 is a partially sectioned side elevation view of a high pressure sodium arc tube according to the present invention during an intermediate stage of manufacture.

FIG. 2 is a partially sectioned side elevation of a completed arc tube according to the present invention.

FIG. 3 is a cross sectional view taken along the line A—A of FIG. 2.

FIG. 4 is a graph showing the relation of lamp current to lamp voltage for high pressure sodium arc tubes of the prior art and of the present invention.

BRIEF DESCRIPTION OF THE PREFERRED EMBODIMENT

Referring to FIG. 1, a light transmissive tubular ceramic body 1, which may be a polycrystalline alumina tube or a monocrystalline sapphire tube, is closed at the ends thereof by closing discs 2, 2' of a similar alumina material. The closing discs 2, 2' have respective central openings through which niobium exhaust tubes 3, 3' pass. A tungsten electrode 4 is provided at the inner ends of each of the exhaust tubes 3, 3'. The closing disc, exhaust tube and alumina tube are secured hermetically with one another by means of sealing glass.

Sodium and mercury are introduced into the arc tube 1 via exhaust tube 3 in a manner to be described hereafter to result in 0.007 mg/cc to 0.054 mg/cc of sodium and 0.054 mg/cc to 0.6 mg/cc of mercury in the arc tube. For especially high efficiency as well as long life of the lamp, the quantities of sodium and mercury added to the arc tube are preferrably within the range of 0.007 mg to 0.018 mg and 0.1 mg to 0.6 mg, for every cubic centimeter of the volume of the arc tube. However, the "quantity" mentioned above means the amounts of each substance acting as an electric discharge medium on lighting, without being lost by combining with other substances.

It has been found to be quite effective to make use of the thermal decomposition of sodium azide (NaN3) to fill the arc tube with the specified amount of sodium in a pure state. Sodium azide, which is a white powder and is stable under atmospheric conditions, decomposes to free sodium and nitrogen (N2) when heated to 400° C. It is possible to feed a controlled quantity of very pure sodium to the arc tube by generating the latter reaction within the arc tube after having insulated the arc tube from the outer atmosphere.

It is very difficult to produce very small particles of mercury of a specific amount. For this purpose however, the thermal decomposition of Titanium-Mercury alloy (Ti-Hg alloy) or Aluminium-Zirconium-Titanum-Mercury alloy (Al-Zr-Ti-Hg alloy), as disclosed in U.S. Pat. No. 3,203,901 and now commercially available as the Mercury Dispenser, can be effectively utilized. The latter alloy can be obtained in the form of a powder molded piece, and separates mercury therefrom at a predetermined rate when heated up to 700° C. The thermal decomposition reaction of the alloy is also obtainable within the arc tube so that a specific predetermined amount of mercury may be entered into the tube.

As a suitable solvent for sodium azide (NaN3), methyl alcohol is preferably used for convenience of the succeeding drying process although sodium azide is also soluble in water. As an example 0.5 g of NaN3 was dissolved in 100 ml of methyl alcohol, and 0.04 ml of the resulting solution was used for one 400 Watt arc tube. The solution was first placed into a filler container or injector 8. The filler container 8 may be of a heat resistant material, such as stainless steel, formed in a tumbler like shape or an elongated tubular shape with one end being closed. After the solvent methyl alcohol dries up, precisely 0.2 mg (500 × 0.04/100) of NaN3 remained in the filler container 8.

Thereafter, 10 mg of Mercury Dispenser, consisting of the Al-Zr-Ti-Hg alloy, was placed into the container 8 to form a mixture 9 with NaN3. The container 8 was then inserted into the exhaust pipe 3, and the open end thereof was closed by welding and pressing. The other exhaust pipe 3' was connected to an exhaust system (not shown) to evacuate the space within the arc tube. The end portion of the exhaust pipe 3 where the container 8 is positioned was heated to 400° C, and the NaN3 decomposed to generate Na and free N2. (2NaN3→2Na + 3N2) Thus, 0.07 mg of Na was generated from 0.2 mg of NaN3, and the simultaneously generated free N2 was exhausted through the exhaust pipe 3'. Subsequent heating of the exhaust pipe 3 to 700° C caused 2 mg of mercury to separate from the Mercury Dispenser. The sodium and mercury thus obtained were vaporized to escape from the exhaust pipe 3, but were condensed within the arc tube by keeping the arc tube cool during the process. A starting gas, for example 20 Torr of Xenon, was introduced through the exhaust pipe 3'. The exhaust pipes 3, 3' were then pinched off at suitable lengths and closed.

Although it will be understood by those skilled in the art that some modifications may be made in the sequence and the manner of above described process, the filling of sodium and mercury into the arc tube is accomplished by making use of sodium azide and Mercury Dispenser, with precise control in quantity and without being contaminated by atmospheric impurities.

It is strictly required for the high pressure sodium vapor lamp of unsaturated vapor pressure type, that all of the sodium and mercury be perfectly vaporized. For this purpose, the thermal conditions within the arc tube must be regulated. Specifically the ends of the arc tube, which are the coolest points therein, must be maintained at a temperature high enough to assure the complete vaporization of the filled substances. A heat insulating sleeve is provided to solve the problem. The sleeve used in the present invention is simpler and highly effective in comparison to such conventional heat insulating sleeves as those consisting only of a metal plate encircling the end portions of the tube or a thermal insulating coating.

The heat insulating sleeve used herein comprises a refractory insulating packing material provided to surround the end portions of the arc tube. As the packing material, quarz wool, alumina wool, and ceramic wool, which are sold individually or in combination may be used. A sheet of such materials is conveniently cut into pieces of suitable size. For mounting the packing material, sheet metal bands are used in such a manner that the opposing ends of the band surrounding the packing material are secured to each other by means of, for example, spot welding, thereby pressing the arc tube by a suitable pressure through the medium of the packing material.

It will be understood that there is no need for employing a special member for fixing the heat insulating sleeve to the tube, since the sleeve exerts a sufficient pressure to hold itself on the arc tube. Since the packing material is electrically insulating, as well as heat insulating, the end portion of the arc tube is conveniently heat-insulated and the coolest point within the tube is kept at a high enough temperature for assuring complete vaporization of the filled substances. In addition, the heat insulating sleeve of the present invention will not drop off the tube and will not peel off as is common with conventional sleeves.

Referring now to FIGS. 2 and 3, sheets 5, 5' of a refractory and insulating packing material are placed around the end portions of the arc tube 1. Then, metal bands 6, 6' are wound around the packing material 5, 5'. The opposing circumferential ends 7, 7' of respective metal bands 6, 6' are brought together and secured to each other by means of spot welding in such a manner that the arc tube 1 is held tightly by the metal bands 6, 6' through the medium of the packing materials 5, 5'. The heat insulating sleeve is thus held onto the arc tube.

The metal bands 6, 6' may be of a thin plate of a heat resistant metal such as nickel, molybdenium, tantalum or stainless steel. The length of the arc tube covered by the heat insulating plate may be 5 to 8 mm for obtaining a satisfactory heat insulating effect which will be increased when the insulating plate is elongated to extend outwardly of the ends of the arc tube 1 thereby encircling the exhaust pipes 3, 3'.

The completed arc tube is then mechanically suspended in an outer jacket or bulb by conventional means, and thereafter required electrical connection is made to provide a high pressure sodium vapor lamp of the invention which is similar in appearance with the conventional ones.

Referring now to FIG. 4, the lamp current versus lamp voltage is shown for a conventional 400 watt high pressure sodium vapor lamp and for a 400 watt lamp made as described above. The curve b is for the conventional lamp, and it can be seen that the lamp voltage increases as the lamp current increases, and the rate of the increase becomes larger as the current increases. Referring to the curve a, which represents the characteristic of a lamp according to the present invention, at the lower currents the lamp voltage increases as the current increases at a rate greater than that in the conventional lamp. However, for increases of the lamp current above the point C, the lamp voltage does not increase and is maintained substantially constant. This is attributable to the fact that the vapor pressure is maintained substantially constant after all of the filled sodium and mercury have been vaporized perfectly.

The point D defined by 110V of lamp voltage and 4.3 A of lamp current shows the rating point of the lamp having lamp output of 400 Watt.

The lamp voltage Vsa under unsaturated vapor pressure varies depending on the quantity of sodium and mercury in the arc tube. The lamp voltage Vsa increases as the quantity of sodium increases, accompanied by the change in spectral characteristic and efficiency, while an increase in quantity of mercury does not affect the spectral characteristic materially. However it also raises the lamp voltage Vsa. Therefore, it is preferable to select the quantity of sodium first to obtain a practically acceptable efficiency and color, and then to determine the quantity of mercury so as to obtain a suitable lamp voltage Vsa.

An economical lamp voltage Vsa is within the range of 70 to 140 V, and more particular in the range of 90 to 130 V.

The volume of the 400 watt arc tube according to the above example was about 5.6 $cm^3$. Thus, the quantities of sodium and mercury in the tube were 0.0126 mg and 0.357 mg, respectively, for every cubic centimeter of the tube volume.

The quantity of sodium is, preferably, 0.007 to 0.054 mg for every cubic centimeter, because the efficiency is unacceptably low for smaller quantities and the durability of the arc tube is reduced for larger quantities of sodium. The above described range of 0.007 to 0.054 mg provides almost the same color as the conventional lamps.

The quantity of mercury is selected, as a rule, in inverse proportion to the quantity of sodium, for the purpose of obtaining the suitable lamp voltage Vsa. The lamp voltage Vsa is too low and too high, respectively, when the quantity of mercury is smaller than 0.054 mg and larger than 0.6 mg, for every cubic centimeter of the tube volume, to be operated economically.

At larger mercury concentrations the lighting color often is pink. The reason why the light is pink is not definitely known. It is supposed the concentration gradient of a sodium atom varies since a mercury atom has high concentration, or that the emission spectrum changes due to formation of Hg-Na molecules. The most preferable quantities of sodium and mercury to obtain high efficiency as well as life durability are within the range 0.007 mg to 0.018 mg and 0.1 mg to 0.6 mg, respectively, for every cubic centimeter of the tube volume.

The following Table I is the result of tests, wherein lamps of 400 W, filled by different quantities of sodium and mercury are measured under 400 W output.

Table 1

| No. | quantity mg/cm³ Na | Hg | lamp voltage V | lamp current A | efficiency lm/W | color |
|---|---|---|---|---|---|---|
| 1 | 0.0126 | 0.357 | 110 | 4.3 | 110 | yellow-white |
| 2 | 0.0126 | 0.803 | 153 | 3.1 | 92 | pink |
| 3 | 0.0315 | 0.178 | 120 | 4.0 | 105 | yellow-white |
| 4 | 0.0315 | 1.07 | 220 | 2.2 | 80 | pink |

What is claimed is:

1. In a sodium vapor electric discharge lamp of the type having an arc tube made of a heat-resistant and light transmissive tubular body with sodium, mercury and a starting gas therein, the improvement characterized by the amounts of said sodium and said mercury being in the ranges of 0.007 to 0.054 mg and 0.054 to 0.6 mg, respectively, for every cubic centimeter of the volume of said arc tube, whereby all of the filled sodium and mercury are vaporized when operated.

2. A sodium vapor electric discharge lamp as claimed in claim 1 further characterized by the amount of sodium being in the range of 0.007 mg/cc to 0.018 mg/cc.

3. A sodium vapor electric discharge lamp as claimed in claim 2 forther characterized by the amount of mercury being in the range of 0.1 mg/cc to 0.6 mg/cc.

4. A sodium vapor electric discharge lamp as claimed in claim 1 further characterized by a heat insulating sleeve tightly and externally surrounding at least one of the end portions of said tubular body where the fill materials exist, said heat insulating sleeve comprising a refractory insulating packing material in contact with said exterior and a metal band tightly surrounding said packing material and holding it to said body.

5. A sodium vapor electric discharge lamp as claimed in claim 3 further characterized by a heat insulating sleeve tightly and externally surrounding at least one of the end portions of said tubular body where the fill materials exists, said heat insulating sleeve comprising a refractory insulating packing material in contact with said exterior and a metal band tightly surrounding said packing material and holding it to said body.

* * * * *